US009480383B2

(12) United States Patent
Wollman

(10) Patent No.: US 9,480,383 B2
(45) Date of Patent: Nov. 1, 2016

(54) CLEANING ATTACHMENT FOR A UTILITY BUCKET

(71) Applicant: David Michael Wollman, Redlands, CA (US)

(72) Inventor: David Michael Wollman, Redlands, CA (US)

( * ) Notice: Subject to any disclaimer, the term of this patent is extended or adjusted under 35 U.S.C. 154(b) by 0 days.

(21) Appl. No.: 14/820,503

(22) Filed: Aug. 6, 2015

(65) Prior Publication Data

US 2016/0037994 A1 Feb. 11, 2016

Related U.S. Application Data

(60) Provisional application No. 62/033,801, filed on Aug. 6, 2014.

(51) Int. Cl.
*A47L 13/52* (2006.01)
*B65F 1/10* (2006.01)

(52) U.S. Cl.
CPC . *A47L 13/52* (2013.01); *B65F 1/10* (2013.01)

(58) Field of Classification Search
CPC ..... A47L 13/52; B65F 1/00; B65F 1/10; B65F 1/14; B65F 1/16; B65F 2210/136
USPC ..... 15/257.1; 220/908, 908.3, 694, 86.1
See application file for complete search history.

(56) References Cited

U.S. PATENT DOCUMENTS

| | | | | | |
|---|---|---|---|---|---|
| 4,312,531 | A * | 1/1982 | Cross | E01H 1/12 | 141/108 |
| 4,470,627 | A * | 9/1984 | Carroll | B65B 67/1238 | 141/108 |
| 4,802,258 | A * | 2/1989 | Jensen | A47L 13/52 | 141/108 |
| 6,974,167 | B2 * | 12/2005 | Springs, II | B65F 1/10 | 15/257.1 |
| 2004/0124195 | A1 * | 7/2004 | Mensch | B65F 1/14 | 220/212 |
| 2011/0283474 | A1 * | 11/2011 | McCoy | A47J 47/18 | 15/257.1 |

* cited by examiner

*Primary Examiner* — Mark Spisich
(74) *Attorney, Agent, or Firm* — Myers Bernstein LLP

(57) ABSTRACT

The present cleaning attachment, for engagement to a rim of a utility bucket, permits the pushing or sweeping of solid and liquid waste up a ramp and into the interior space of the bucket. The ramp of the attachment is connected to a frame configured to engage the rim of the bucket. A waste retention wall at the back of the ramp creates a contained volume and blocks the waste from exiting the bucket once swept in.

15 Claims, 5 Drawing Sheets

CLEANING ATTACHMENT FOR A UTILITY BUCKET

This application claims the benefit of prior Provisional Application No. 62/033,801, filed Aug. 6, 2014.

BACKGROUND

The field of the present device relates to cleaning attachments, and more particularly, to cleaning attachments for attachment to a container.

It is common to collect debris from a surface with a dustpan and deposit it into a utility bucket. Presently, in order to contain large amounts of debris and/or liquids, the utility bucket must remain upright while the user scoops the debris and places it into the interior of the utility bucket. If the user were to lay the utility bucket on its side for easy access to sweep debris into the bucket interior, liquids and debris may exit the bucket or hinder new debris from being swept in. A device is needed that enables a user to conveniently lay a utility bucket on its side so that debris and liquids can be swept into the bucket, while substantially preventing debris and liquids from exiting.

SUMMARY

A cleaning attachment for a utility bucket is provided, where the cleaning attachment has a rim engagement portion for engaging the rim of the utility bucket in releasably locked engagement; a ramped portion extending from the rim engagement portion, the ramped portion having a leading edge and a back edge, the back edge of the ramped portion extending across the rim engagement portion to connect with the rim engagement portion at a first part and a second part along the rim engagement portion; and a waste retention wall spanning an area between the rim engagement portion and the back edge of the ramped portion. When the attachment is attached to the utility bucket laid horizontally the leading edge of the ramped portion touches the surface and the ramped portion angularly extends to the opening of the utility bucket. Additionally, the waste is moved up the ramped portion, over the back edge, and into the interior space of the utility bucket, the waste retention wall substantially preventing the waste from exiting the interior space of the utility bucket.

Optionally, the rim engagement portion further has a top portion and a bottom portion, a rim engagement groove being formed on the bottom portion. One or both of the rim engagement portion and rim engagement groove may be semiannular. The waste retention wall may be a solid wall.

As another option, the curved rim engagement portion may form a water resistant engagement with the rim of the utility bucket, where the solid wall prevents waste water from exiting the interior space of the utility bucket. Optionally, the rim is circular with a diameter, and the rim engagement portion conforms at least in part to the rim. The area between the rim engagement portion and the back edge of the ramped portion may be circular segment shaped, and the waste retention wall spans an entirety of the area.

As an option, the height of the waste retention wall is defined by the back edge, the height ranging approximately between one-tenth and one-half the diameter or may range approximately between one inch and 8 inches.

An alternate cleaning attachment for a utility bucket may include a curved frame with a rim engagement groove, where the rim engagement groove is configured for receiving the circular rim of the utility bucket in releasably locked engagement, and the curved frame has a first part and a second part situated along a curve of the curved frame; a ramp extending across the curved frame to connect with the first part and the second part, where a segment area is defined within the curve, the first part, and the second part; and a waste retention wall at least partially spanning the segment area. When the attachment is attached to the circular rim of the utility bucket laid horizontally the ramped portion touches the surface and the ramped portion angularly extends to the opening of the utility bucket. And when waste is moved up the ramped portion and into the interior space of the utility bucket, the waste retention wall substantially prevents the waste from exiting the interior space of the utility bucket.

Optionally, the rim engagement groove forms a water resistant engagement with the rim of the utility bucket, the waste retention wall configured for preventing waste water from exiting the interior space of the utility bucket. The waste retention wall may span an entirety the segment area. As an option, the ramp may further have a back edge proximal to the curved frame and a leading edge distal to the curved frame. Again optionally, the rim engagement groove may have an inner curved wall concentric within an outer curved wall, where the outer curved wall is segmented into two or more wall sections, and at least one of the wall sections having a tab extending radially from an outer side of the wall section.

Figure 1:
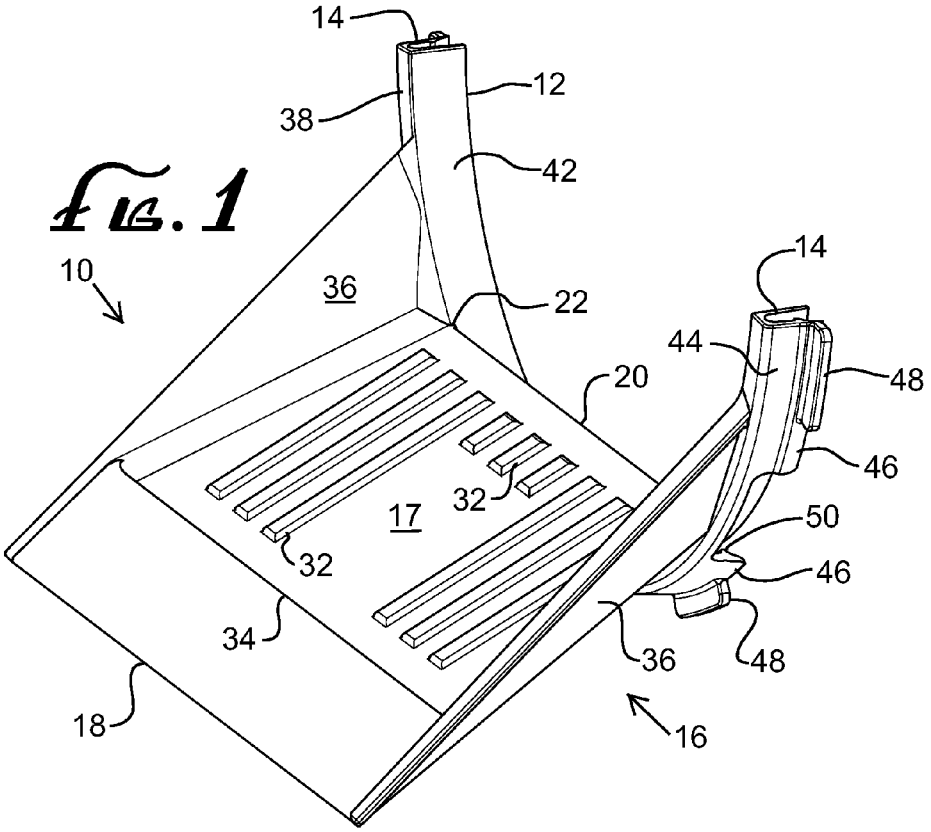
FIG. 1 is a front left perspective view of an example embodiment of the present cleaning attachment.
Figure 2:
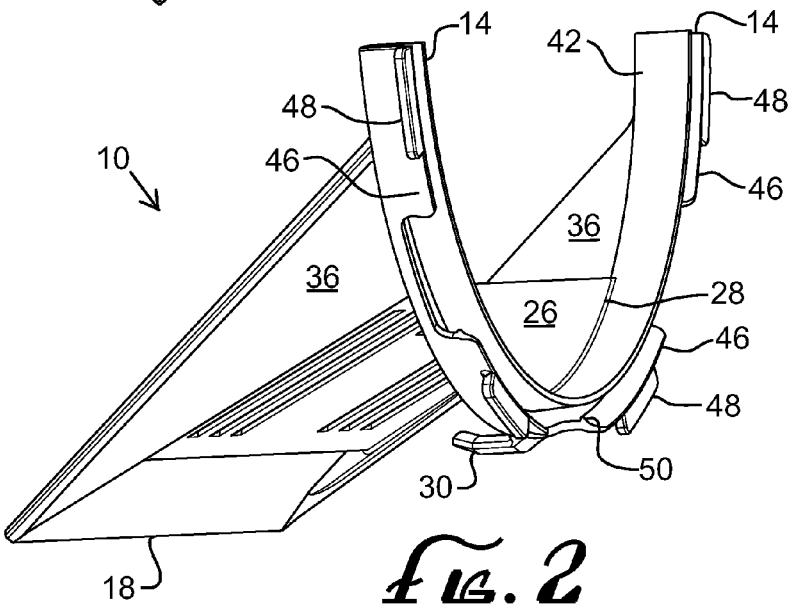
FIG. 2 is a back left perspective view of the embodiment of FIG. 1.

LISTING OF REFERENCE NUMERALS OF FIRST-PREFERRED EMBODIMENT cleaning attachment 10
curved frame or rim engagement portion 12
rim engagement groove 14
ramp or ramped portion 16
ramp surface 17
leading edge 18
back edge 20
first frame part 22
second frame part 24
waste retention wall 26
contained volume 27
area or segment area 28
handle 30
ribs 32 shoulder 34
sidewall 36
top portion 38
bottom portion 40
inner curved wall 42
outer curved wall 44
wall section 46
tab 48
engagement lip 50
height h
utility bucket 100
interior space 102
rim 104
opening 106
surface 200
solid waste 202
water or liquid waste 204
broom 300

DESCRIPTION OF THE PREFERRED EMBODIMENTS

The detailed descriptions set forth below in connection with the appended drawings are intended as a description of embodiments, and is not intended to represent the only forms in which the present securement system may be constructed and/or utilized. The descriptions set forth the structure and the sequence of steps for constructing and operating the securement system in connection with the illustrated embodiments. It is to be understood, however, that the same or equivalent structures and steps may be accomplished by different embodiments that are also intended to be encompassed within the spirit and scope of the invention.

Referring to the example embodiment illustrated in FIGS. 1-4, the present cleaning attachment (10) is illustrated generally with a curved frame (12) or rim engagement portion with a ramped portion or ramp (16) extending from the curved frame. The ramp (16) acts as an incline plane to guide debris and/or liquids up the ramp (16) and into the utility bucket, as will be described further below. The ramp (16) has a leading edge (18), a back edge or back portion (20), and a sidewall (36) on each side of the ramp (16). The ramp (16) is shown connected to the top portion (38) of the curved frame (12), although the ramp (16) can be molded to various parts of the curved frame (12) as required. The sidewalls (36) connect between the ramp surface (17) and the curved frame (12) to increase rigidity and strength of the ramp (16) and to further control the flow of debris swept up the ramp (16).

The back edge (20) of the ramp (16) intersects or connects with the inner curved wall (42) of the curved frame (12) at a first frame part (22) and a second frame part (24). The first frame part (22) and the second frame part (24) are on different portions of the curved frame (12); and if the curved frame (12) were to be circular, the back edge would be much like a chord of a circle connecting the first frame part (22) and the second frame part (24) on the circle. Again, if the curved frame (12) were to be circular, the area (28) between the back edge (20) and the curved frame (12), in this case the inner curved wall (42), forms a segment area (28), which is much like the segment of a circle. The area (28) is preferably spanned by a waste retention wall (26), which also looks much like a segment of a circle in this example. The main purpose of the waste retention wall (26) is to prevent waste from exiting the utility bucket once swept in.

The ramp (16) has further rigidizing structures, which includes a series of ribs or corrugations (32) formed in the sheet material of the ramp surface (17) to substantially prevent bending along the ramp (16) incline. A shoulder (34) is formed across the ramp surface (17), which permits dust and small debris to pass over the shoulder (34) flowing towards the back edge (20), yet substantially prevents back-flow of this debris towards the leading edge (18) once over the shoulder (34).

The curved frame (16) has an annular channel or rim engagement groove (14) formed on it bottom portion or wall (40), where the groove (14) has an inner curved wall (42) spaced apart and concentric within an outer curved wall (44). An engagement lip (50) may be formed on an inside wall of the groove (14), in between the inner curved wall (42) and the outer curved wall (44). The engagement lip (50) is ramped to permit the rim of the bucket to push out the outer curved wall (44) and trap the rim within the groove (14) until the user disengages the rim. To ease removal of the cleaning attachment (10) from the utility bucket, the outer curved wall (44) may be segmented into one or more wall sections (46). Each wall section (46) has the engagement lip (50) on the inside wall of the outer curved wall (44). Extending radially from the outer curved wall (44) of each wall section (46) is a tab (48). By sectioning the outer curved wall (44) and providing tabs (48) on each wall section (46), the user can easily remove the cleaning attachment from the utility bucket by successively pulling each wall section (46) outward and away from the rim by grasping the tab (48) and pulling to disengage the bucket rim from the engagement lip (50). Extending from the curved frame (12) is a handle (30), that enables the user to hold and transport the utility bucket and cleaning attachment (10) together by hooking one or more fingers about the handle (30).

Figure 3:
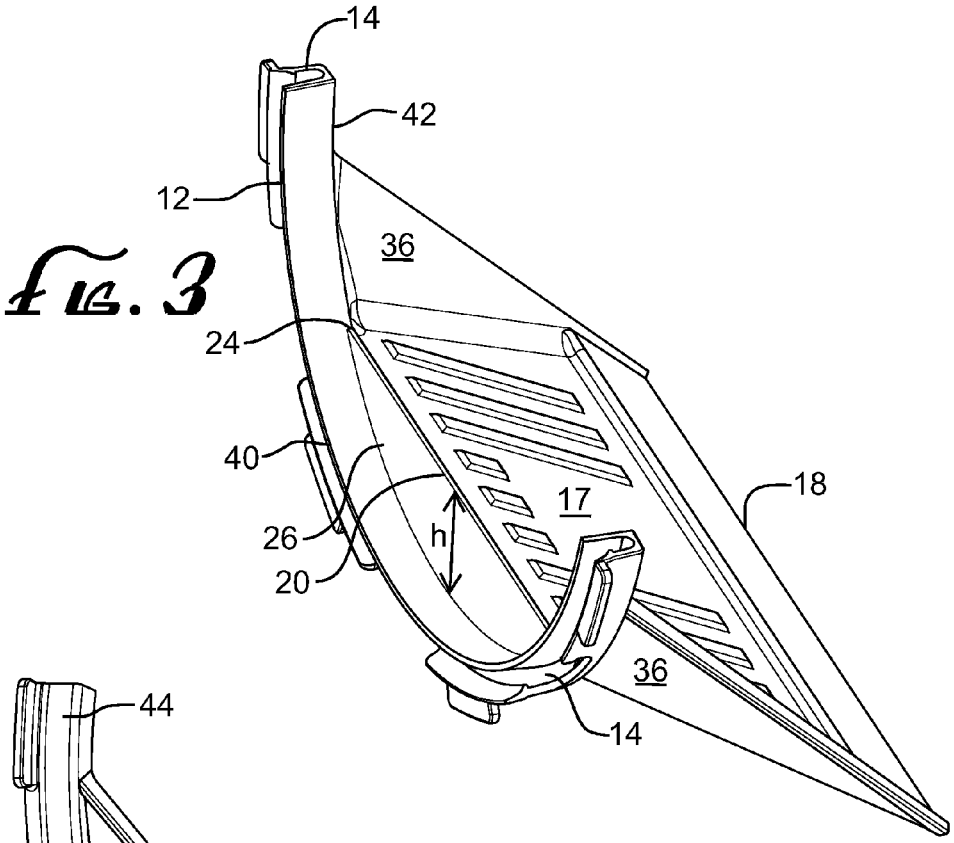
FIG. 3 is a back right perspective view of the embodiment of FIG. 1.
Figure 4:
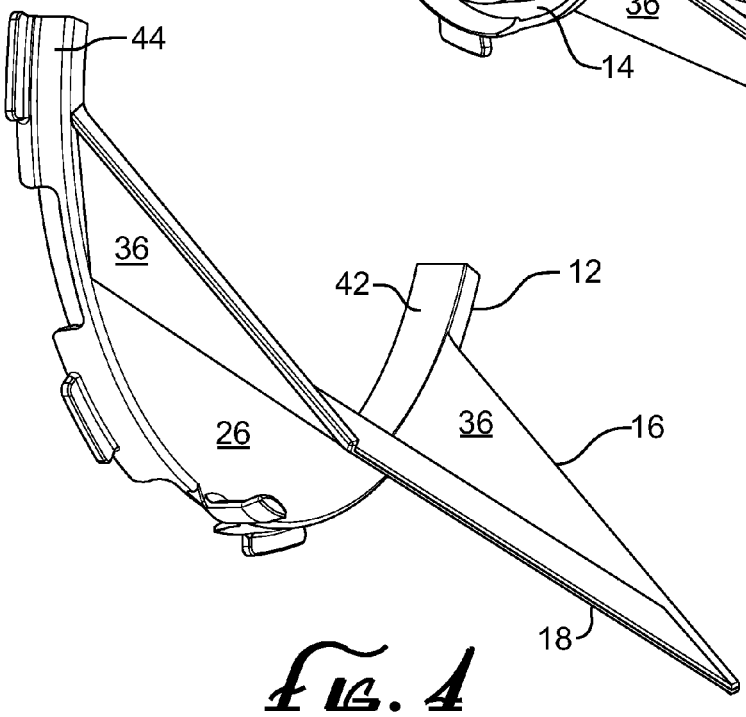
FIG. 4 is a front bottom perspective view of the embodiment of FIG. 1.

Referring to FIG. 3, the waste retention wall (26) can be seen spanning the area or segment area (26). The waste retention wall (26) in conjunction with the ramp (16) creates a ramped dam, where debris and waste pushed up the ramp (16) and over the back edge (20) and into the bucket is substantially prevented from exiting the bucket due to being trapped behind the waste retention wall (26). The height (h) of the waste retention wall (26) is variable depending on the requirements of usage and the bucket size. In one example, also referring to FIG. 5, a standard utility bucket (100) has an opening (106) encircled by a rim (104) with a diameter of approximately 12 inches. The cleaning attachment (10) made to fit this example bucket (100) would have a curved frame (12) with a rim engagement groove (14) having a diameter complementary to the diameter of the rim (104). The height (h) of the waste retention wall (26) can be varied from about one-half inch to about 8 inches, although a higher waste retention wall (26) is possible, it may become impractical as the height (h) approaches the length of the diameter. A height (h) of approximately three inches is preferred. Of course, a larger or smaller diameter bucket may require the height (h) be adjusted as a function of bucket rim (104) diameter, groove (14) diameter, or curved frame (12) diameter. For example, the height (h) may vary from about one-tenth to about one-half the diameter of either the bucket rim (104), groove (14), or curved frame (12). Heights (h) below one-tenth of the diameter or above one-half of the diameter are also possible.

Figure 5:
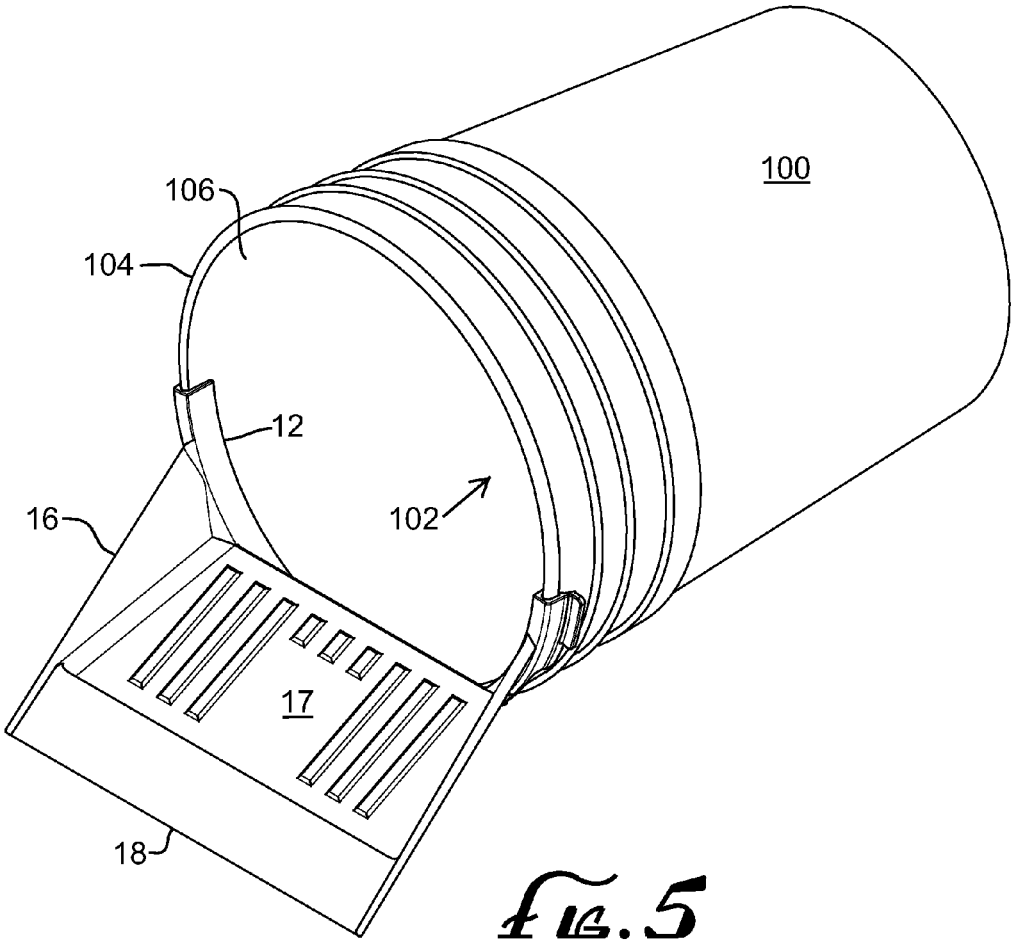
FIG. 5 is a perspective view of the present cleaning attachment connected to the rim of a utility bucket.
Figure 6:
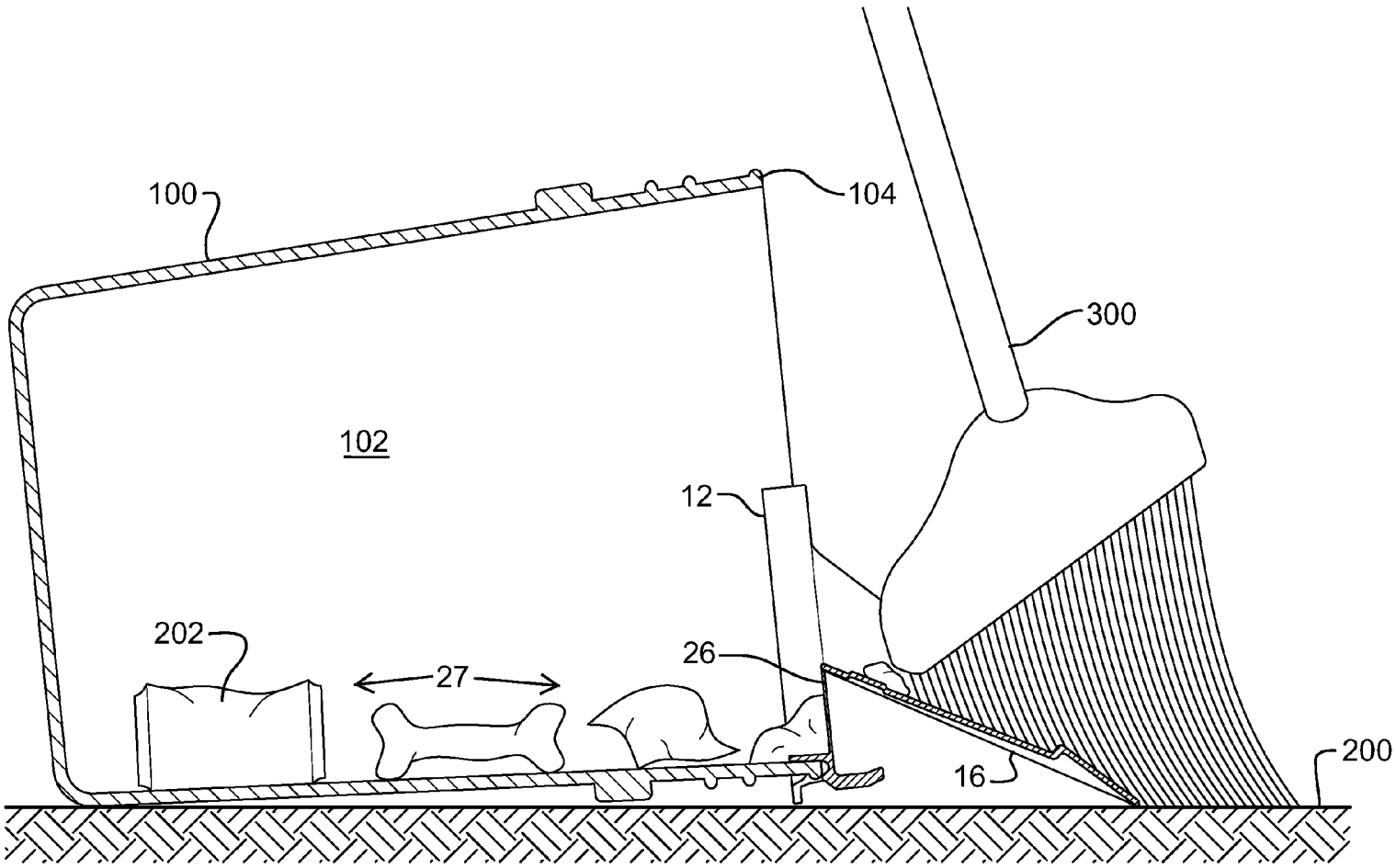
FIG. 6 is a cross-sectional side view of the present cleaning attachment connected to the rim of a utility bucket, showing various solid waste debris being swept up the ramp and being contained within the interior space.
Figure 7:
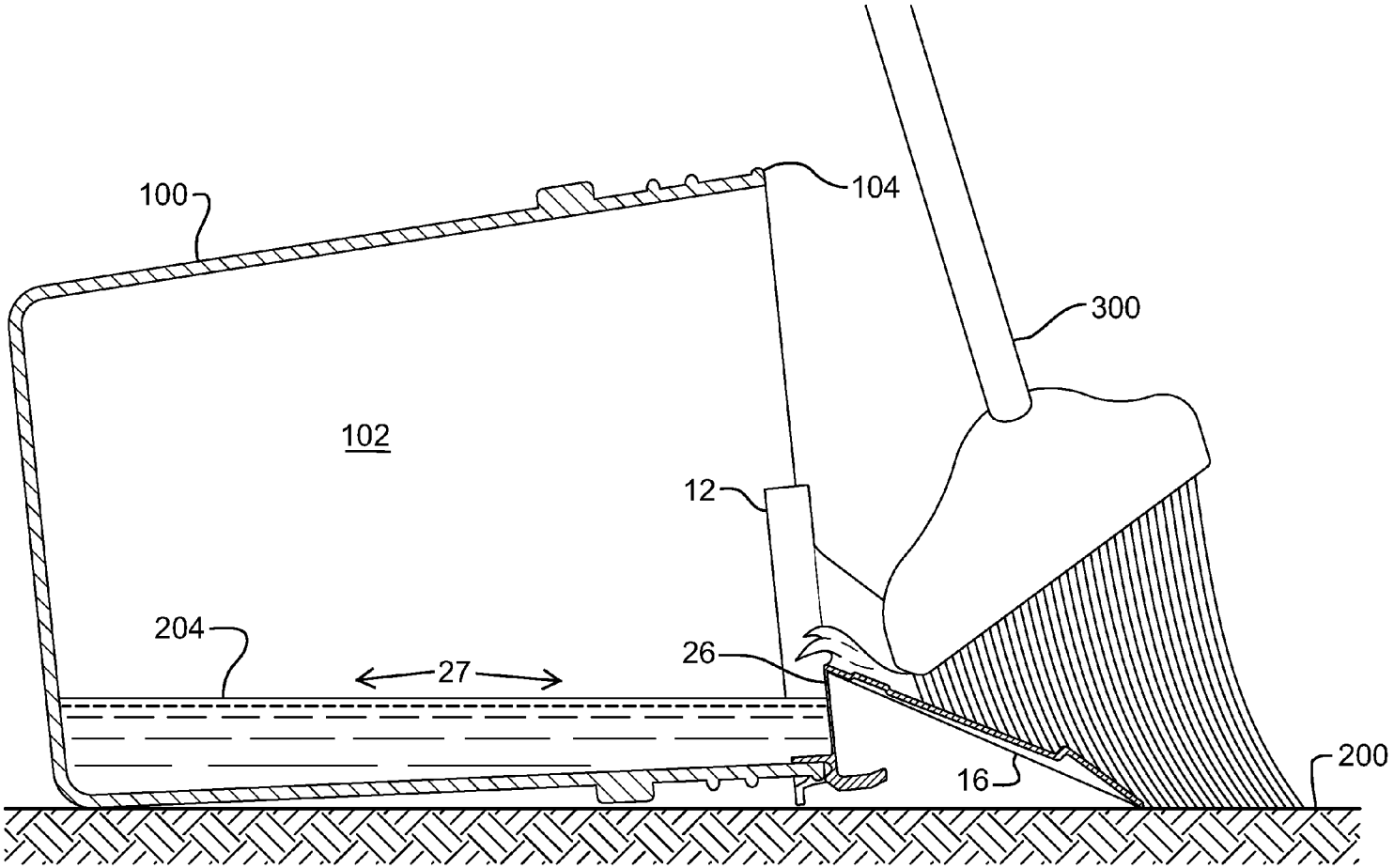
FIG. 7 is a cross-sectional side view of the present cleaning attachment connected to the rim of a utility bucket, showing liquid or water waste being swept up the ramp and being contained within the interior space

In FIGS. 5-7, a utility bucket (100) with a round opening (106) and rim (104) is shown. However, the present cleaning attachment (10) may be used with buckets of various opening shapes and configurations, such as a rectangular or oblong opening and rim. In the rectangular opening example, the rim engagement portion (12) would be a partial or whole square or rectangular frame which is shaped to engage the rectangular rim of the bucket. Further, the shape of the waste retention wall (26) may vary accorded to the shape of the bucket. In the case of the illustrated round bucket (100), the waste retention wall (26) may be shaped like a circular segment as described above. In the case of a square or rectangular bucket, the waste retention wall (26) may also be rectangular or triangular if the cleaning attachment (10) is attached to one corner and two adjacent sides of the bucket.

Still referring to the example cleaning attachment (10) of FIGS. 5-7, the attachment is attached to a utility bucket (100) by engaging the rim (104) of the bucket (100). The bucket (100) is shown laying horizontally on its side, with the ramp (16) extending down to contact the support surface 200 with the leading edge (18). The ramp (16) also serves to stabilize the bucket (100) by contacting the support surface with the leading edge (18) to prevent rolling.

FIGS. 6-7 show a cross-sectional view of the cleaning attachment connected to the bucket (100). FIG. 6 shows debris on other solid waste (202) being swept up the ramp (16) and into the interior space (102) of the bucket (100), by a broom (300). FIG. 7 shows waste liquids or water (204) being swept up the ramp (16) and into the interior space (102) of the bucket (100), by a broom (300) or a squeegee may be used. The waste retention wall (26) is shown blocking the exit of the waste (202, 204), so that it acts as a trap capture the waste within the interior space (102) of the bucket (100). The waste retention wall (26) and the wall of the bucket (100) form a contained volume (27) in which the waste is contained.

While particular forms of the present securement system have been illustrated and described, it will also be apparent to those skilled in the art that various modifications can be made without departing from the spirit and scope of the design. Accordingly, it is not intended that the invention be limited except by the claims.

What is claimed is:

1. An attachment for a utility bucket having an interior space, an opening, and a rim girding the opening, the attachment guiding waste from a surface to the interior space; the attachment comprising:

a rim engagement portion for engaging the rim of the utility bucket in releasably locked engagement;

a ramped portion extending from the rim engagement portion, the ramped portion having a leading edge and a back edge, the back edge of the ramped portion extending across the rim engagement portion to connect with the rim engagement portion at a first part and a second part along the rim engagement portion; and a waste retention wall spanning an area between the rim engagement portion and the back edge of the ramped portion;

wherein when the attachment is attached to the utility bucket laid horizontally the leading edge of the ramped portion touches the surface and the ramped portion angularly extends to the opening of the utility bucket;

and wherein waste is moved up the ramped portion, over the back edge, and into the interior space of the utility bucket, the waste retention wall substantially preventing the waste from exiting the interior space of the utility bucket.

2. The attachment of claim 1 wherein the rim engagement portion further comprises a top portion and a bottom portion, a rim engagement groove being formed on the bottom portion.

3. The attachment of claim 2 wherein the rim engagement groove is semiannular.

4. The attachment of claim 3 wherein the rim engagement portion is semiannular.

5. The attachment of claim 1 wherein the waste retention wall is a solid wall.

6. The attachment of claim 5 wherein the rim engagement portion forms a water resistant engagement with the rim of the utility bucket, the solid wall preventing waste water from exiting the interior space of the utility bucket.

7. The attachment of claim 1 wherein the rim is circular with a diameter, the rim engagement portion conforming at least in part to the rim, and wherein the area between the rim engagement portion and the back edge of the ramped portion is circular segment shaped, the waste retention wall spanning an entirety of the area.

8. The attachment of claim 7 wherein a height of the waste retention wall is defined by the back edge, the height ranging approximately between one-tenth and one-half the diameter.

9. The attachment of claim 7 wherein a height of the waste retention wall is defined by the back edge, the height ranging approximately between one inch and 8 inches.

10. An attachment for a utility bucket having an interior space, an opening, and a circular rim about the opening, the attachment guiding waste from a surface to the interior space; the attachment comprising:

a curved frame with a rim engagement groove, the rim engagement groove configured for receiving the circular rim of the utility bucket in releasably locked engagement, the curved frame having a first part and a second part situated along a curve of the curved frame;

a ramp extending across the curved frame to connect with the first part and the second part, a segment area defined within the curve, the first part, and the second part; and a waste retention wall at least partially spanning the segment area;

wherein, when the attachment is attached to the circular rim of the utility bucket laid horizontally the ramped portion touches the surface and the ramped portion angularly extends to the opening of the utility bucket;

and wherein waste is moved up the ramped portion and into the interior space of the utility bucket, the waste retention wall substantially prevents the waste from exiting the interior space of the utility bucket.

11. The attachment of claim 10 wherein the rim engagement groove forms a water resistant engagement with the rim of the utility bucket, the waste retention wall configured for preventing waste water from exiting the interior space of the utility bucket.

12. The attachment of claim 10 wherein the waste retention wall spans an entirety of the segment area.

13. The attachment of claim 10 wherein the ramp further comprises a back edge proximal to the curved frame and a leading edge distal to the curved frame.

14. The attachment of claim 13 wherein a maximum height between the back edge and the curved frame ranges approximately between one-tenth and one-half a diameter of the curved frame.

15. The attachment of claim 10 wherein the rim engagement groove comprises an inner curved wall concentric within an outer curved wall, the outer curved wall segmented into two or more wall sections, at least one of the wall sections having a tab extending radially from an outer side of the wall section.

* * * * *